US007318742B2

(12) United States Patent
Morikawa

(10) Patent No.: US 7,318,742 B2
(45) Date of Patent: Jan. 15, 2008

(54) SHIELD TERMINAL FOR COAXIAL CABLE

(75) Inventor: Taishi Morikawa, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/155,566

(22) Filed: Jun. 20, 2005

(65) Prior Publication Data

US 2005/0282434 A1 Dec. 22, 2005

(30) Foreign Application Priority Data

Jun. 18, 2004 (JP) ..... P2004-181174

(51) Int. Cl.
*H01R 4/24* (2006.01)

(52) U.S. Cl. ..... 439/394; 439/584; 439/578; 174/75 C

(58) Field of Classification Search ..... 439/578, 439/394, 584–585; 174/75 C
See application file for complete search history.

(56) References Cited

U.S. PATENT DOCUMENTS 4,998,895 A * 3/1991 Forney et al. ..... 439/585
5,078,619 A * 1/1992 Whittle et al. ..... 439/578
5,632,651 A * 5/1997 Szegda ..... 439/578
6,083,034 A 7/2000 Kameyama
6,753,475 B2 * 6/2004 Takahashi et al. ..... 174/75 C
6,808,417 B2 * 10/2004 Yoshida ..... 439/585
2003/0224656 A1 12/2003 Yoshida

FOREIGN PATENT DOCUMENTS

JP 2003-297493 A 10/2003

OTHER PUBLICATIONS

Chinese Office Action dated Apr. 6, 2007.

* cited by examiner

*Primary Examiner*—Truc Nguyen
(74) *Attorney, Agent, or Firm*—Sughrue Mion, PLLC

(57) ABSTRACT

A shield terminal for a coaxial cable, which is adapted to be electrically connected to a braid exposed at a terminal portion of the coaxial cable includes a shield portion which encompasses the outside of a core wire exposed at the terminal portion of the coaxial cable, a sleeve formed into a hollow cylindrical shape and adapted to be inserted between an insulator of the coaxial cable and the exposed braid when the insulator is fittingly inserted into the interior of the sleeve, a braid clamping portion adapted to hold the exposed braid together with the sleeve by being compressed and a sheath clamping portion adapted to hold a sheath of the coaxial cable by being compressed, and a slit is formed in the sleeve in such a manner as to divide a circumferential wall of the sleeve in a circumferential direction thereof.

4 Claims, 5 Drawing Sheets

SHIELD TERMINAL FOR COAXIAL CABLE

BACKGROUND OF THE INVENTION

The present invention relates to a shield terminal for a coaxial cable.

A coaxial cable such as an antenna cable that is used for transmission of high-frequency signals is generally constructed such that an outer circumference of a core wire is covered with a braid via an insulator and furthermore, an outer circumference of the braid is covered with an insulating sheath. Then, as a connector for connecting such a coaxial cable to a mating device or coaxial cable, there has been known a shield terminal adapted to shield the coaxial cable from electrical noise such as electromagnetic wave and static electricity by earth connecting the braid of the coaxial cable to a mating connector (for example, refer to Patent Document 1).

As shown in FIG. 6, a coaxial cable shield terminal 100, which is disclosed in Patent Document 1, is made up of an outer conductor terminal 113 formed of a conductive sheet material and a shield body 114, and is secured to a terminal end portion of a coaxial cable W in which a sheath Wd, a braid Wc and an insulator Wb are cut for predetermined lengths, respectively, so that a core wire Wa, the insulator Wb and the braid Wc are sequentially exposed.

The outer conductor terminal 113 has a shield portion 113*a* which is formed into a cylindrical shape and a sleeve 113*b* which is provided in such a manner as to extend rearward of the shield portion 113*a* and is formed into a cylindrical shape having a smaller diameter than the shield portion 113*a*. The shield portion 113*a* receives in the interior thereof the core wire Wa exposed at the terminal portion of the coaxial cable W and an inner conductor terminal 111 mounted on the core wire Wa for electromagnetic shielding.

When the sleeve 113*b* is connected to the coaxial cable W, the insulator Wb exposed at the terminal portion of the coaxial cable W is fittingly inserted into the interior of the sleeve 113*b*, whereby the sleeve 113*b* is inserted between the braid Wc exposed at the terminal portion of the coaxial cable W and the insulator Wb situated radially inward of the braid Wc.

The shield body 114 is joined to the outer conductor terminal 113 in such a manner as to close an opening 113*c* at a rear end of the shield portion 113*a*, and a sheath clamping portion 114*b* provided at a rear end of the shield body 114 clamps a sheath Wd of the coaxial cable W by being compressed, whereby the shield body 114 is fixed to the terminal portion of the coaxial cable W together with the outer conductor terminal 113.

A braid clamping portion 114*a*, which is provided at a position on the shield body 114 which corresponds to the sleeve 113*b* when the shield body 114 is jointed to the outer conductor terminal 113, is compressed onto the sleeve 113*b*, so that the braid Wc, which covers the sleeve 113*b*, is held by the sleeve 113*b* and the braid clamping portion 114*a*, whereby the outer conductor terminal 113 and the shield body 114 are electrically connected to the braid Wc. Then, the braid Wc of the coaxial cable W is earth connected to a mating connector when the outer conductor terminal 113 is electrically connected to an earth terminal of the mating connector. Patent Document 1:JP-A-2003-297493 (pages 4 to 7, FIG. 3)

In the related coaxial cable shield terminal 100, however, the sleeve 113*b* is formed into the cylindrical shape having an inside diameter that is equal to or slightly larger than the outside diameter of the insulator Wb so that the insulator Wb of the coaxial cable W can fittingly be inserted into the sleeve 113*b*, and the construction of the sleeve 113*b* makes it difficult for the sleeve 113*b* to be deformed plastically.

Consequently, when the braid clamping portion 114*a* of the shield body 114 is compressed, the braid Wc which covers the sleeve 113*b* is only held by the sleeve 113*b* and the braid clamping portion 114*a*, and the insulator Wb, which is fittingly inserted into the interior of the sleeve 113*b*, is fixed in no case. Namely, the shield terminal 100 is fixed to the coaxial cable only by the sheath clamping portion 114*b* of the shield body 114, and there exists a possibility that the position of the shield terminal 100 is deviated with respect to the coaxial cable W. In case there occurs the positional deviation of the shield terminal, an unreasonable force is applied to the braid Wc which is held by the sleeve 113*b* and the braid clamping portion 114*a*, leading to a risk that the braid Wc is broken due to the force so applied, whereby a good electrical connection cannot be obtained between the shield terminal 100 and the braid Wc.

Furthermore, in the event that the clamping by the braid clamping portion becomes insufficient due to loosening that occurs in association with the springback of the braid clamping portion 114*a* after compression or with a lapse of time, the braid Wc cannot be held sufficiently between the sleeve 113*b* and the braid clamping portion 114*a*, leading to the risk that a good electrical connection cannot be obtained between the shield terminal 100 and the braid Wc.

In addition, in a coaxial cable which transmits high-frequency signals, in a case where the characteristic impedance of the coaxial cable is not aligned with the characteristic impedance of the shield terminal, a reflection of signal occurs. This reflection causes noise and energy loss. Then, the shield terminal 100, which constitutes a return circuit for signals, is made up by joining together the outer conductor terminal 113 and the shield body 114, which are separate components from each other, and there may be a case where an impedance disturbance occurs at the joint portion, and consequently, there has been a risk that the high-frequency wave characteristics of the coaxial cable W is deteriorated.

SUMMARY OF THE INVENTION

The invention was made in view of the situations, and an object thereof is to provide a shield terminal for a coaxial cable which can provide a stable electric connection with respect to a braid of the coaxial cable and keep the high-frequency wave characteristics of the coaxial cable in a good condition.

With a view to attaining the object, a shield terminal for a coaxial cable according to the invention is characterized in the following arrangement.

(1) A shield terminal for a coaxial cable that includes a core wire, an insulator covering the core wire and a braid covering the insulator, the shield terminal comprising:

a shield portion adapted to encompass the core wire;

a hollow cylindrical sleeve adapted to be inserted between the insulator and the braid; and a braid clamping portion adapted to clamp the braid so as to hold the braid together with the sleeve, wherein the shield portion, the sleeve and the braid clamping portion are formed integrally with each other.

(2) A shield terminal according to (1) further comprising a sheath clamping portion adapted to clamp an insulating sheath of the coaxial cable, which covers the braid.

(3) A shield terminal according to (1), wherein the sleeve is formed with a slit in an axial direction of the sleeve.

(4) A shield terminal according to (3), wherein the slit has a gap so as to divide a circumferential wall of the sleeve in a circumferential direction of the sleeve.

(5) A shield terminal according to (3), wherein the slit is formed from one end portion of the sleeve to the other end portion of the sleeve in the axial direction.

According to the present invention, by forming the slit in the cylindrical sleeve, which is inserted between the insulator and the braid of the coaxial cable when the insulator of the coaxial cable is fittingly inserted into the interior thereof, in such a manner as to divide the circumferential wall of the sleeve in the circumferential direction, the sleeve can be constructed in such a manner as to elastically be deformed so as to increase or reduce the width of the slit to thereby expand or contract a space therein.

Then, the slit is elastically deformed so as to reduce the width of the slit in association with the compression of the braid clamping portion and then contracts the interior space of the sleeve to thereby clamp the insulator of the coaxial cable which is fittingly inserted into the sleeve, whereby the shield terminal can strongly be fixed to the coaxial cable by the braid clamping portion and the sleeve, and the sheath clamping portion, so that the prevention of the positional deviation of the shield terminal relative to the coaxial cable can be ensured. Consequently, there is no case where an unreasonable force is applied to the braid of the coaxial cable which is held between the sleeve and the braid clamping portion, thereby making it possible to ensure a stable electrical connection between the shield terminal and the braid of the coaxial cable.

Furthermore, even in the event that the clamping by the braid clamping portion becomes insufficient due to loosening that would occur in association with the springback of the braid clamping portion after compression or with a lapse of time, the state in which the braid of the coaxial cable is held between the sleeve and the braid clamping portion can be maintained in an ensured fashion due to the memory of the sleeve, thereby making it possible to ensure a stable electrical connection between the shield terminal and the braid of the coaxial cable.

In addition, by integrating the shield portion, the sleeve and the braid clamping portion of the shield terminal with each other, a joint portion can be eliminated from a path of return circuit current of the coaxial cable shield terminal, whereby the characteristic impedance of the shield terminal can be controlled accurately so as to facilitate the alignment thereof with the characteristic impedance of the coaxial cable, thereby making it possible to maintain the high-frequency wave characteristics of the coaxial cable in a good condition.

According to the present invention, a stable electrical connection can be attained with respect to the braid of the coaxial cable, and the high-frequency wave characteristics of the coaxial cable can be maintained in a good condition.

DETAIL DESCRIPTION OF PREFERRED EMBODIMENTS

Hereinafter, a preferred embodiment according to the invention will be described in detail based on the drawings.

Figure 1:
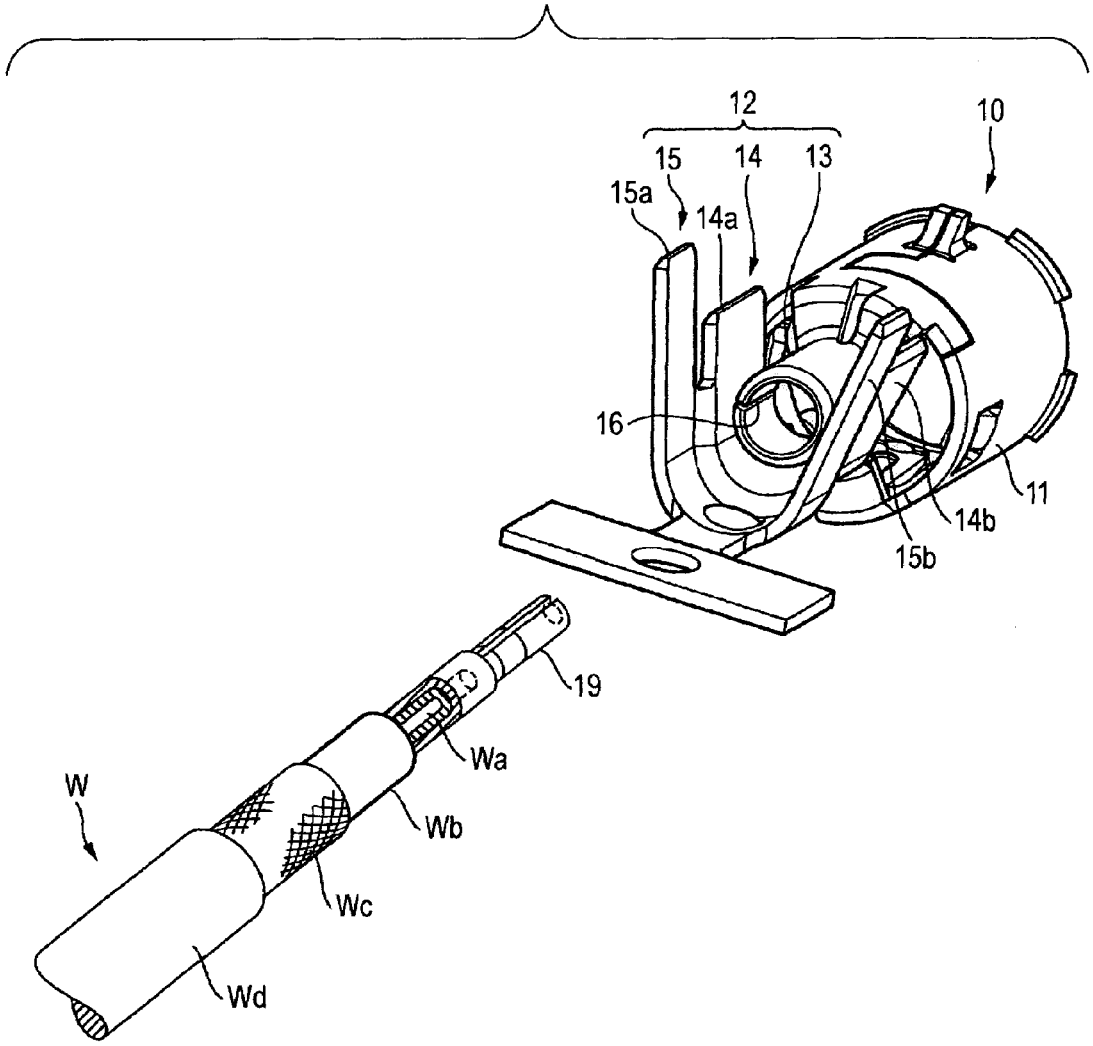
FIG. 1 is a perspective view showing a shield terminal for a coaxial cable, which is an embodiment of the invention, and the coaxial cable.
Figure 2:
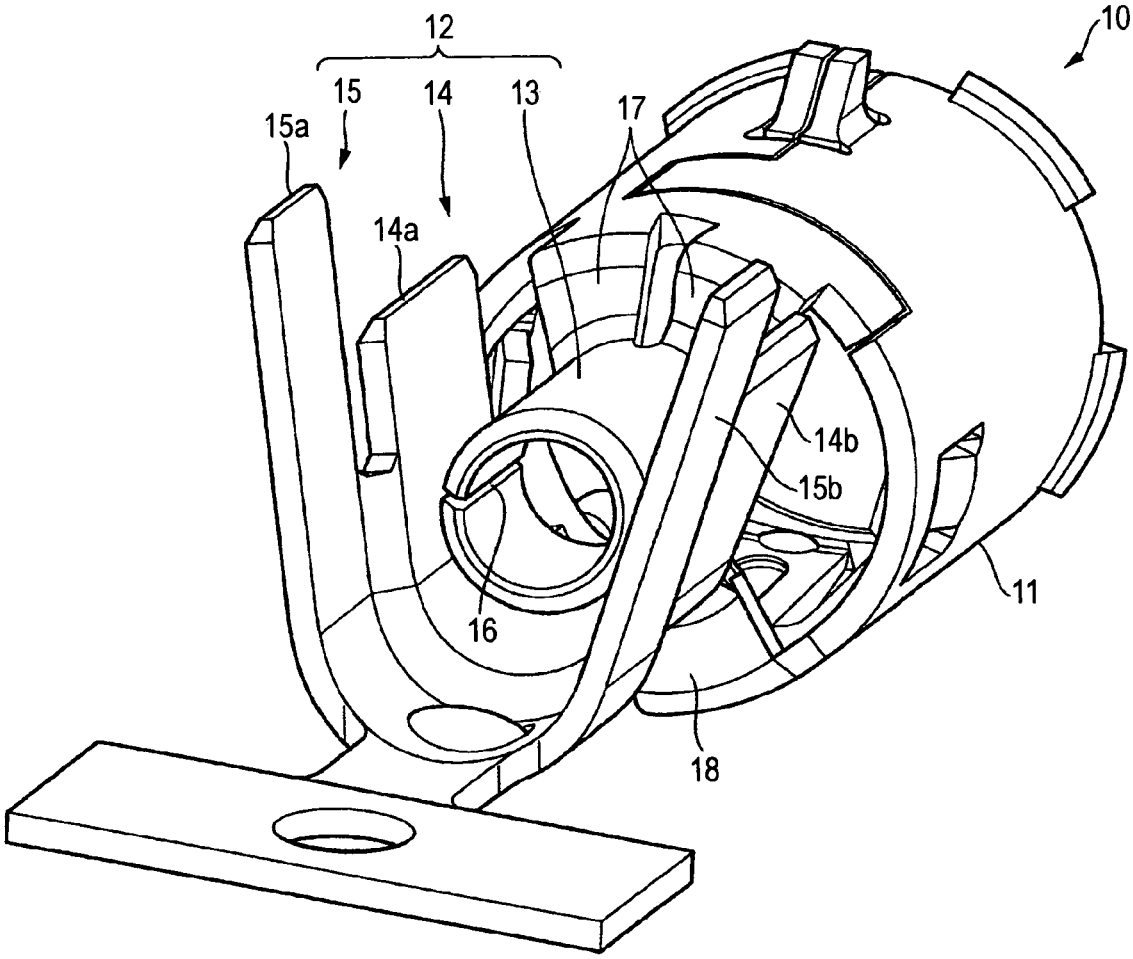
FIG. 2 is a perspective view showing only the shield terminal shown in FIG. 1.
Figure 3:
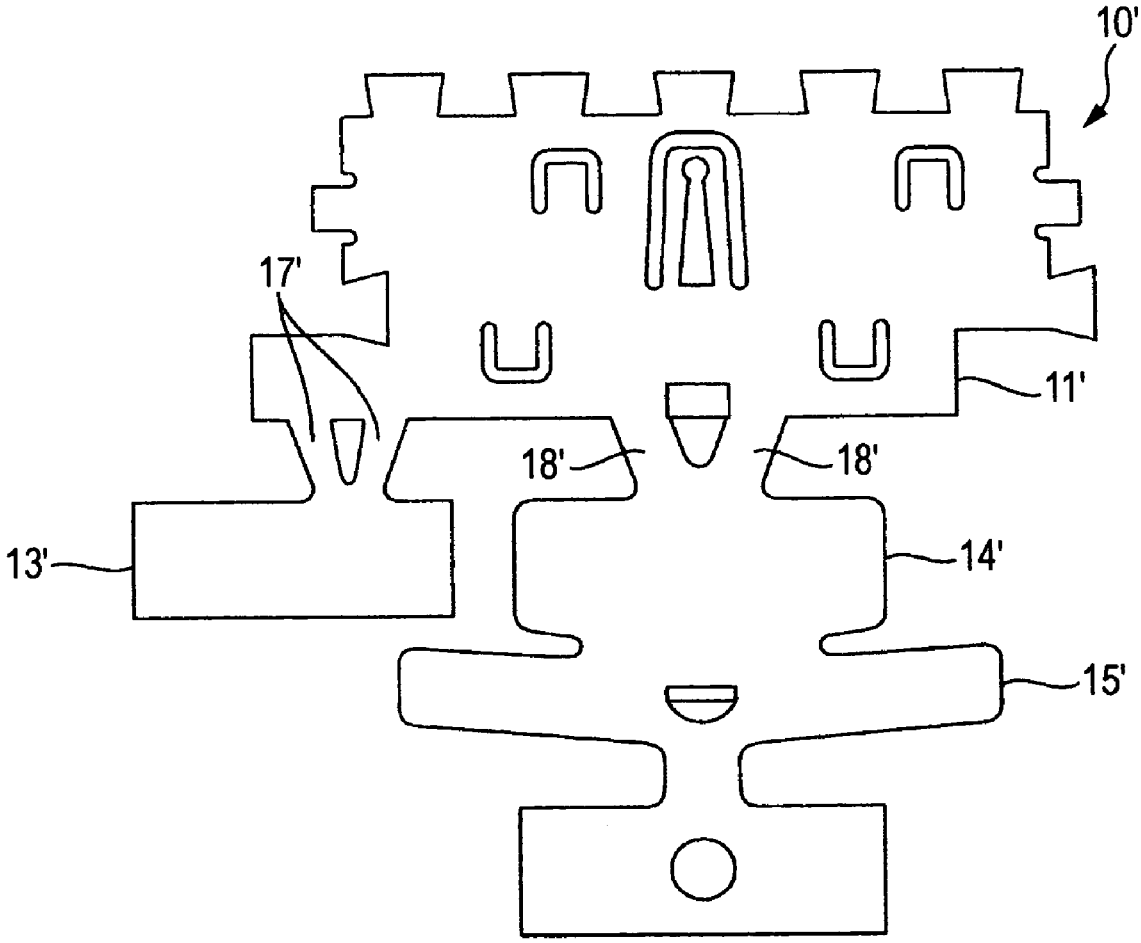
FIG. 3 is a development of the shield terminal shown in FIG. 2.
Figure 4:
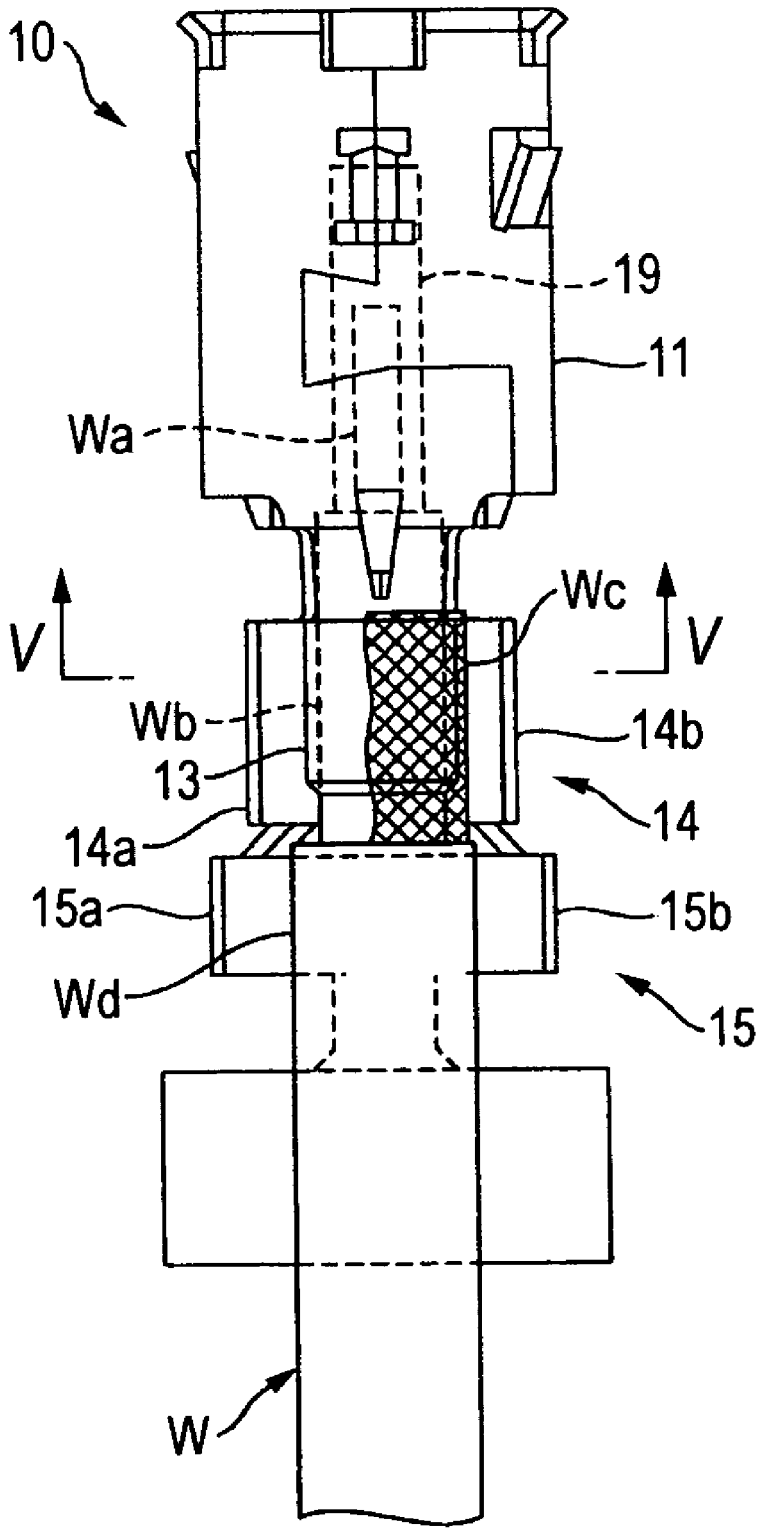
FIG. 4 is a plan view showing a state in which the shield terminal shown in FIG. 1 is fixed to a terminal portion of the coaxial cable.
Figure 5:
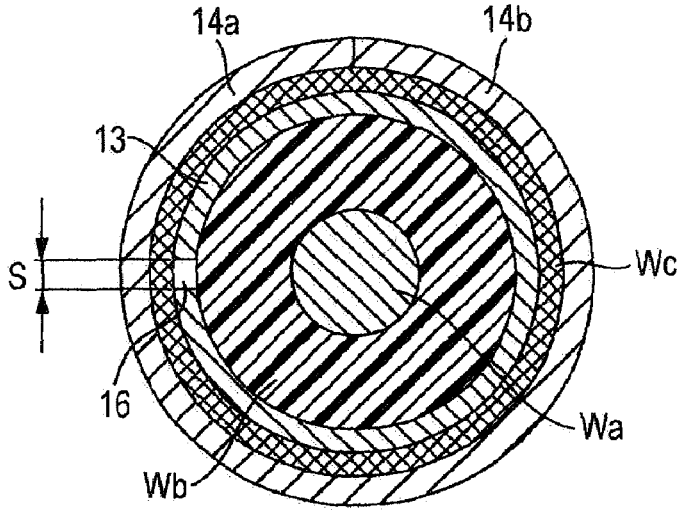
FIG. 5 is a sectional end view taken along the line V-V in FIG. 4 and viewed in a direction indicated by arrows.
Figure 6:
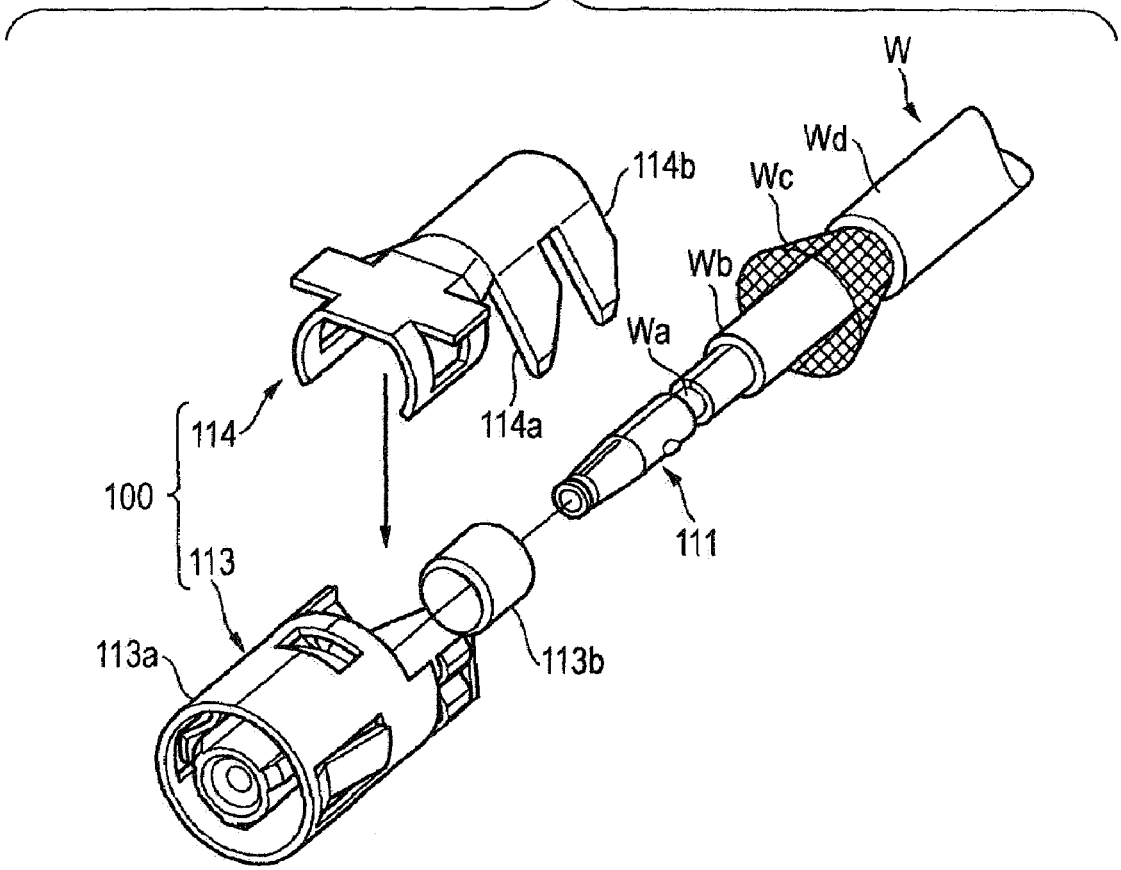
FIG. 6 PRIOR ART
FIG. 6 is a perspective view showing a related shield terminal for a coaxial cable and the coaxial cable.

FIG. 1 is a perspective view showing a shield terminal for a coaxial cable, which is an embodiment of the invention, and the coaxial cable, FIG. 2 is a perspective view showing only the shield terminal shown in FIG. 1, FIG. 3 is a development of the shield terminal shown in FIG. 2, FIG. 4 is a plan view showing a state in which the shield terminal shown in FIG. 1 is fixed to a terminal portion of the coaxial cable, and FIG. 5 is a sectional end view taken along the line V-V in FIG. 4 and viewed as indicated by arrows.

As shown in FIGS. 1 to 3, a shield terminal 10 for a coaxial cable according to an embodiment of the invention is an integrally formed produce of a conductive sheet material by pressing and is electrically connected to a braid Wc of a coaxial cable W having a single core. The coaxial cable W is made up of a core wire Wa, an insulator Wb which covers an outer circumference of the core wire Wa, a braid Wc which covers an outer circumference of the insulator Wb and an insulating sheath Wd which covers an outer circumference of the braid Wc.

The sheath Wd, the braid Wc and the insulator Wb are peeled off for predetermined lengths at a terminal portion of the coaxial cable W, so that the core wire Wa, the insulator Wb and the braid Wc are sequentially exposed for predetermined lengths from a protruding end of the terminal portion of the coaxial cable W. Then, an inner terminal 19 for fitting connection is securely contracted or compressed for connection to the core wire Wa so exposed.

The shield terminal 10 has a substantially cylindrical shield portion 11 which accommodates therein the inner terminal 19 which is securely compressed onto the core wire Wa of the coaxial cable W while the inner terminal 19 is being disposed on a center axis of the shield portion 11 and a compressing portion 12 that is provided back of the shield portion 11 (that is, on an opposite end to a protruding end of the coaxial cable in a state the shield terminal is mounted on the coaxial cable W, or on a basal end thereof).

As shown in FIG. 3, the shield portion 11 is formed by bending a substantially rectangular shield portion corresponding sheet material 11' into substantially a cylindrical shape.

The compressing portion 12 has a hollow, substantially cylindrical sleeve 13 adapted to be inserted between the insulator Wb and the braid Wc when the insulator Wb exposed at the terminal portion of the coaxial cable W is fittingly inserted into the interior of the sleeve 13, a braid clamping portion 14 adapted to hold the braid Wc together with the sleeve 13 by being compressed and a sheath clamping portion 15 adapted to clamp the sheath Wd of the coaxial cable W by being compressed.

As shown in FIG. 3, the sleeve 13 is formed by bending a substantially rectangular sleeve corresponding sheet material 13' into a substantially cylindrical shape which corresponds to an external shape of the insulator Wb of the coaxial cable W. Note that the sleeve corresponding sheet material 13' is integrated with the shield corresponding sheet material 11' via a linking portion corresponding sheet material 17' and that the sleeve 13, which is formed substantially cylindrically, is supported in such a manner that a center axis thereof coincides with the center axis of the shield portion 11 by a linking portion 17 which is extended from an upper rear end edge of the shield portion 11.

An inside diameter of the sleeve 13 is made to be equal to or slightly larger than an outside diameter of the insulator Wb of the coaxial cable W, and a slit 16, which divides a circumferential wall of the sleeve 13 in a circumferential direction thereof, is formed by providing a gap S (refer to FIG. 5) at a location where the sleeve 13 is to be joined.

The braid clamping portion 14 is formed by bending a substantially rectangular braid clamping portion corresponding sheet material 14' into a substantially arc-like shape so that a central portion of the substantially rectangular braid clamping portion corresponding sheet material 14' extends along an outer circumferential surface of the sleeve 13 with an appropriate gap being held therebetween and that both side end portions (hereinafter, referred to as braid clamping pieces) 14*a*, 14*b* thereof are brought to an erect state and is supported by a linking portion 18 which is extended from a lower rear end edge of the shield portion 11.

The sheath clamping portion 15 is formed by bending a substantially rectangular sheath clamping portion corresponding sheet material 15' into a substantially arc-like shape so that a central portion of the substantially rectangular sheath clamping portion corresponding sheet material 15' extends along an outer circumferential surface of the sheath Wd of the coaxial cable W and that both side end portions (hereinafter, referred to as sheath clamping pieces) 15*a*, 15*b* are brought to an erect state and is disposed back of the braid clamping portion 14 in such a manner as to continue thereto.

Note that the shield portion corresponding sheet material 11', a linking portion corresponding sheet material 18', the braid clamping portion corresponding sheet material 14' and the sheath clamping portion corresponding sheet material 15' are formed integrally as shown in FIG. 3. Namely, the shield terminal 10 is formed integrally in such a manner that no joining portion exists at all between the respective constituent members such as the shield portion 11, the sleeve 13, the braid clamping portion 14 and the sheath clamping portion 15.

As shown in FIGS. 4 and 5, the terminal portion of the coaxial cable W is inserted into the shield terminal 10 from a rear end opening of the sleeve 13, whereby the shield terminal 10 is fixed to the terminal portion. As this occurs, the core wire Wa, which is exposed at the terminal portion of the coaxial cable W, and the inner terminal 19, which is securely compressed onto the core wire Wa, are disposed on the center axis of the shield portion 11 so as to be encompassed from the outside thereof by the shield portion 11 to thereby be shielded electromagnetically.

In addition, the exposed insulator Wb is fittingly inserted into the interior of the sleeve 13, so that the sleeve 13 is inserted between the insulator Wb and the exposed braid Wc. Furthermore, the exposed braid Wc is disposed in a gap between the sleeve 13 and the braid clamping portion 14.

From this state, the pair of braid clamping pieces 14*a*, 14*b* of the braid clamping portion 14 and the pair of sheath clamping pieces 15*a*, 15*b* of the sheath clamping portion 15 are compressed. As this occurs, the braid Wc, which is disposed in the gap between the sleeve 13 and the braid clamping portion 14, is held by the sleeve 13 and the braid clamping portion 14, and the sleeve 13 is elastically deformed and diametrically contracted in such a manner as to reduce the width (that is, the gap S) of the slit 16, whereby the insulator Wb, which is fittingly inserted into the interior of the sleeve 13, is clamped by the sleeve 13. In addition, the sheath Wd of the coaxial cable W is clamped by the sheath clamping portion 15.

By adopting the construction that has been described above, the shield terminal 10 is fixed to the terminal portion of the coaxial cable W by the sheath clamping portion 15, the sleeve 13 and the braid clamping portion 14 and is electrically connected to the braid Wc of the coaxial cable W at the sleeve 13 and the braid clamping portion 14.

In addition, the shield terminal 10, which is securely compressed onto the coaxial cable W for connection, is received in the interior of a shield terminal housing (not shown), made of an insulating resin, through which the coaxial cable W has already been passed and which waits back of the shield terminal 10 from an opening at a front end portion of the shield terminal housing, and when the shield terminal housing is brought into fitting engagement with a mating housing, the shield terminal 10 and the inner terminal 19 are electrically connected to mating members, respectively.

According to the shield terminal 10 that is constructed as has been described heretofore, by forming the slit 16 with the sleeve 13 which is inserted between the insulator Wb and the braid Wc of the coaxial cable W when the insulator Wb of the coaxial cable W is fittingly inserted into the interior of the sleeve 13 in such a manner as to divide the circumferential wall of the sleeve 13 in the circumferential direction thereof and to have a gap, the sleeve 13 is elastically deformed in such a manner as to increase or reduce the width of the slit 16 to thereby be allowed to expand or contract diametrically.

Then, the sleeve 13 diametrically contracts in association with the compression of the braid clamping portion 14 so as to clamp the insulator Wb of the coaxial cable W, which is fittingly inserted into the interior thereof, whereby the shield terminal 10 can strongly be fixed to the coaxial cable W by the braid clamping portion 14 and the sleeve 13, and the sheath clamping portion 15, and the positional deviation of the shield terminal 10 with respect to the coaxial cable W can be prevented in an ensured fashion. Consequently, there occurs no case where an unreasonable force is applied to the braid Wc of the coaxial cable W, which is held between the sleeve 13 and the braid clamping portion 14, thereby making it possible to provide a stable electrical connection between the shield terminal 10 and the braid Wc of the coaxial cable W.

Furthermore, even in the event that the clamping by the braid clamping portion 14 becomes insufficient due to loosening that occurs in association with the springback after compression or with a lapse of time, the state in which the braid Wc of the coaxial cable W is held between the sleeve 13 and the braid clamping portion can be held in an ensured fashion due to the memory of the sleeve 13, thereby making it possible to provide a stable electrical connection between the shield terminal 10 and the braid Wc of the coaxial cable W.

In addition, the shield portion 11, the sleeve 13, the braid clamping portion 14 and the sheath clamping portion 15 of the coaxial cable shield terminal 10 are formed integrally, and therefore, any joint portion can be eliminated from the path of return circuit current of the shield terminal 10, whereby the characteristic impedance of the shield terminal 10 can be controlled accurately so as to facilitate the alignment thereof with the characteristic impedance of the coaxial cable W, thereby making it possible to maintain the high-frequency wave characteristics of the coaxial cable in a good condition. In addition, since the shield terminal 10 is made up of the single member, the fixing of the shield terminal 10 to the terminal portion of the coaxial cable W can be effected easily, thereby making it possible to increase the working efficiency.

Note that the shield terminal of the present invention is not limited to the embodiment that has been described heretofore but may be modified and improved as appropriate. In addition, the shapes, dimensions, numerical values, forms, numbers, disposition locations of the respective constituent elements are not limited to those described in the embodiment but may be modified arbitrarily, provided that they can work to attain the invention.

For example, while in the aforesaid embodiment, the shape of the sleeve is formed into the substantially cylindrical shape, the shape of the sleeve is not limited thereto but the sleeve may be formed in any way as long as the sleeve remains to conform to the external shape of the insulator of the coaxial cable. Namely, in the event that the insulator of the coaxial cable is formed into a polygonal shape, the sleeve is also formed into the polygonal shape.

In addition, the slit that is formed with the sleeve may be formed in any way as long as the slit is formed in such a manner as to divide the circumferential wall of the sleeve in the circumferential direction thereof. Namely, the slit may be formed in parallel with the center axis of the sleeve or may be formed to incline in a direction in which the slit intersects the center axis. Alternatively, the slit may be formed to be bent in a crank-like fashion.

Additionally, while the embodiment has been described as the shield terminal being fixed to the terminal portion of the coaxial cable having the single core, the invention can be applied to a coaxial cable having two or more cores.

What is claimed is:

1. A shield terminal for a coaxial cable that includes a core wire, an insulator covering the core wire and a braid covering the insulator, the shield terminal comprising:

a shield portion adapted to encompass the core wire;

a hollow cylindrical sleeve adapted to be inserted between the insulator and the braid, and formed with a slit in an axial direction of the sleeve; and a braid clamping portion adapted to clamp the braid so as to hold the braid together with the sleeve, wherein the slit has a gap so as to divide a circumferential wall of the sleeve in a circumferential direction of the sleeve.

2. A shield terminal according to claim 1 further comprising a sheath clamping portion adapted to clamp an insulating sheath of the coaxial cable, which covers the braid.

3. A shield terminal according to claim 1, wherein the slit is formed from one end portion of the sleeve to the other end portion of the sleeve in the axial direction.

4. A shield terminal according to claim 1, wherein the shield portion, the sleeve and the braid clamping portion are formed integrally with each other.

* * * * *